US008494382B2

(12) United States Patent
Na

(10) Patent No.: US 8,494,382 B2
(45) Date of Patent: Jul. 23, 2013

(54) SWITCHING MODE POWER SUPPLYING APPARATUS, FUSING APPARATUS TO PREVENT A FLICKER PHENOMENON FROM OCCURRING, AND IMAGE FORMING APPARATUS INCLUDING THE SAME

(75) Inventor: Tae-kwon Na, Yongin-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 313 days.

(21) Appl. No.: 12/731,283

(22) Filed: Mar. 25, 2010

(65) Prior Publication Data

US 2011/0085813 A1 Apr. 14, 2011

(30) Foreign Application Priority Data

Oct. 14, 2009 (KR) ..... 10-2009-97742

(51) Int. Cl.
*G03G 15/00* (2006.01)

(52) U.S. Cl.
USPC ..... 399/37; 399/88

(58) Field of Classification Search
USPC ..... 399/37, 88; 307/45, 46, 64–67, 85, 307/86
See application file for complete search history.

(56) References Cited

U.S. PATENT DOCUMENTS 4,725,740 A * 2/1988 Nakata ..... 307/64
5,493,155 A * 2/1996 Okamoto et al. ..... 307/45
5,592,030 A * 1/1997 Adahan ..... 307/80
5,781,422 A * 7/1998 Lavin et al. ..... 363/37
5,969,438 A * 10/1999 Odaohara ..... 307/80
5,982,645 A * 11/1999 Levran et al. ..... 363/37
6,542,705 B2 * 4/2003 Fujita et al. ..... 399/69
6,605,881 B2 * 8/2003 Takehara et al. ..... 307/86
6,761,581 B2 * 7/2004 Takehara et al. ..... 439/502
7,122,767 B2 * 10/2006 Sato et al. ..... 219/497
7,247,816 B2 * 7/2007 Kishi et al. ..... 219/216
7,258,572 B2 * 8/2007 Milan ..... 439/502
2002/0043523 A1 * 4/2002 Fujita et al. ..... 219/216
2004/0066094 A1 * 4/2004 Suzuki et al. ..... 307/18
2006/0051120 A1 * 3/2006 Kishi et al. ..... 399/69
2006/0222395 A1 * 10/2006 Yoda ..... 399/69
2009/0293523 A1 * 12/2009 Bittner et al. ..... 62/236
2011/0084555 A1 * 4/2011 Pan ..... 307/75
2012/0078433 A1 * 3/2012 Honma et al. ..... 700/295

* cited by examiner

*Primary Examiner* — G. M. Hyder
(74) *Attorney, Agent, or Firm* — Stanzione & Kim, LLP

(57) ABSTRACT

A switching mode power supply apparatus includes an alternating current (AC) power input unit to receive an AC voltage from an AC power supply source, a first rectifier to output a direct current (DC) voltage by rectifying the received AC voltage, a pulse width modulation (PWM) signal generator to output a PWM signal, a transformer to transform the DC voltage output from the first rectifier into an AC voltage according to a turn ratio and outputting the AC voltage according to the PWM signal, a second rectifier to output a DC voltage by rectifying the AC voltage output from the transformer, a feedback unit to provide as feedback a change of the DC voltage output from the second rectifier to the PWM signal generator, a DC power input unit to receive a DC voltage from a DC power supply source, a DC voltage input detector to detect whether a DC voltage is input to the DC power input unit based on connectivity with the DC power input unit, and an AC power input controller to stop input of the AC voltage from the AC power supply source based on whether a DC voltage is input to the DC power input unit.

31 Claims, 9 Drawing Sheets

SWITCHING MODE POWER SUPPLYING APPARATUS, FUSING APPARATUS TO PREVENT A FLICKER PHENOMENON FROM OCCURRING, AND IMAGE FORMING APPARATUS INCLUDING THE SAME

CROSS-REFERENCE TO RELATED APPLICATIONS

This application claims the benefit under 35 U.S.C.§119(a) of Korean Patent Application No. 10-2009-0097742, filed on Oct. 14, 2009, in the Korean Intellectual Property Office, the disclosure of which is incorporated herein in its entirety by reference.

BACKGROUND

1. Field of the Invention

The present general inventive concept relates to a switching mode power supplying apparatus and a fusing apparatus, which operate by using an alternating current power and a direct current.

2. Description of the Related Art

As generation of electric power from sunlight is generalized at home, studies to commercialize a direct current (DC) voltage transmission are being performed. According to supply of solar cells, a DC voltage of 60 V or below is supplied at home. However, since electronic devices used at home only include an alternating current (AC) power input terminal to which an AC voltage is input, the electronic devices cannot receive DC voltage. A switching mode power supplying apparatus of an image forming apparatus that mainly uses a low DC voltage requires a method of receiving a DC voltage and operating with the received DC voltage. In case of a fusing apparatus installed inside the image forming apparatus, since a heating element of the fusing apparatus is heated only by using an AC voltage, a large amount of power may be consumed to initially increase the temperature of the fusing apparatus, and a flicker phenomenon may occur accordingly. Thus, a method of preventing the flicker phenomenon from occurring is required.

SUMMARY

The present general inventive concept provides a switching mode power supplying apparatus that operates by receiving an alternating current (AC) voltage and a direct current (DC) voltage from an AC power supply source and a DC power supply source.

The present general inventive concept also provides a fusing apparatus that prevents a flicker phenomenon from occurring by using an AC voltage and a DC voltage.

Additional features and utilities of the present general inventive concept will be set forth in part in the description which follows and, in part, will be obvious from the description, or may be learned by practice of the general inventive concept.

Features and/or utilities of the present general inventive concept may be realized by a switching mode power supply apparatus including an alternating current (AC) power input unit to receive an AC voltage from an AC power supply source, a first rectifier to output a direct current (DC) voltage by rectifying the received AC voltage, a pulse width modulation (PWM) signal generator to output a PWM signal, a transformer to transform the DC voltage output from the first rectifier into an AC voltage according to a turn ratio and to output the AC voltage according to the PWM signal, a second rectifier to output a DC voltage by rectifying the AC voltage output from the transformer, a feedback unit to provide as feedback a change of the DC voltage output from the second rectifier to the PWM signal generator, a DC power input unit to receive a DC voltage from a DC power supply source, a DC voltage input detector to detect whether a DC voltage is input to the DC power input unit based on connectivity with the DC power input unit; and an AC power input controller to stop input of the AC voltage from the AC power supply source based on whether a DC voltage is input to the DC power input unit.

Features and/or utilities of the present general inventive concept may also be realized by a fusing apparatus including an alternating current (AC) power input unit to receive an AC voltage from an AC power supply source, an AC voltage heating element to emit heat according to the AC voltage, an AC voltage controller to control a voltage input operation of the AC power input unit and a heat emitting operation of the AC voltage heating element, a direct current (DC) power input unit to receive a DC voltage from a DC power supply source, a DC voltage heating element to emit heat according to the DC voltage, a DC voltage controller to control a heat emitting operation of the DC voltage heating element, and a heating controller for independently controlling the AC voltage controller and the DC voltage controller by outputting a first driving signal to control an operation of the AC voltage controller to the AC voltage controller and a second driving signal to control an operation of the DC voltage controller to the DC voltage controller. The heating controller may block an AC voltage input to the AC power input unit by outputting the first driving signal when a DC voltage is input to the DC power input unit.

Features and/or utilities of the present general inventive concept may be realized by a power supply including an AC voltage input terminal, a DC voltage input terminal, an AC-to-DC conversion circuit to convert a first AC voltage received at the AC voltage input terminal to a first DC voltage to be output from the power supply, a DC voltage input detection circuit to detect a second DC voltage received at the DC voltage input terminal, and a voltage control circuit to disable the AC-to-DC conversion circuit when the DC voltage input detection circuit detects the second DC voltage. The DC voltage input terminal may include a mechanical switch, and the mechanical switch may be a part of the DC voltage input detection circuit. When the second DC voltage is input to the DC voltage input terminal, the voltage control circuit may cause the second DC voltage to be output from the power supply.

The AC-to-DC conversion circuit may include a first rectifier to convert the first AC voltage to a third DC voltage, a transformer to convert the third DC voltage to a second AC voltage different from the first AC voltage, a second rectifier to convert the second AC voltage to the first DC voltage, and a pulse width modulation (PWM) signal generator to control operation of the transformer.

The voltage control circuit may cause the PWM signal generator to stop an input of the third DC voltage to the transformer when the DC voltage input detection circuit detects the second DC voltage.

The voltage control circuit may drive to ground a power supply voltage to the PWM signal generator when the DC voltage input detection circuit detects the second DC voltage.

The power supply may further include a switch located between the AC power input terminal and the first rectifier, and when the DC voltage input detection circuit detects the second DC voltage, the voltage control circuit may open the switch to prevent the first AC voltage from being transmitted to the first rectifier.

Features and/or utilities of the present general inventive concept may be realized by an image-forming apparatus including an image-forming unit to transfer an image to a recording medium, an AC voltage input terminal, a DC voltage input terminal, and a power supply including an AC-to-DC conversion circuit to convert a first AC voltage received at the AC voltage input terminal to a first DC voltage to be output from the power supply, a DC voltage input detection circuit to detect a second DC voltage received at the DC voltage input terminal, and a voltage control circuit to disable the AC-to-DC conversion circuit when the DC voltage input detection circuit detects the second DC voltage.

The image-forming apparatus according to claim may include a fusing unit to fuse the image to the recording medium, the fusing unit including an AC voltage heating element to receive an AC voltage from the AC voltage input terminal and to generate heat based on the received AC voltage, a DC voltage heating element to receive a DC voltage from the DC voltage input terminal and to generate heat based on the received DC voltage, and a fusing unit controller to receive the AC voltage and the DC voltage and to output an AC voltage heating element control signal and a DC voltage heating element control signal to control operation of the AC voltage heating element and the DC voltage heating element, respectively.

The fusing unit controller may include an AC voltage detector and a DC voltage detector, and the fusing unit controller may output the AC voltage heating element control signal based on whether the AC voltage detector detects the AC voltage and whether the DC voltage detector detects the DC voltage.

The fusing unit controller may output the DC voltage heating element control signal based only on whether the DC voltage detector detects the DC voltage.

The fusing unit controller may include an AC voltage controller including the AC voltage detector, a DC voltage controller including the DC voltage detector, and a heating controller to receive an AC voltage detection signal from the AC voltage detector and a DC voltage detection signal from the DC voltage detector and to output the AC voltage heating element control signal and the DC voltage heating element control signal.

The heating controller may output the AC voltage heating element control signal and the DC voltage heating element control signal directly to the AC voltage heating element and the DC voltage heating element, respectively.

The heating controller may output the AC voltage heating element control signal and the DC voltage heating element control signal to the AC voltage controller and the DC voltage controller, respectively, to control operation of the AC voltage heating element and the DC voltage heating element, respectively.

Features and/or utilities of the present general inventive concept may be realized by a fusing unit of an image-forming apparatus including an AC voltage heating element to receive an AC voltage from an AC voltage input terminal and to generate heat based on the received AC voltage, a DC voltage heating element to receive a DC voltage from a DC voltage input terminal and to generate heat based on the received DC voltage, and a fusing unit controller to receive the AC voltage and the DC voltage and to output an AC voltage heating element control signal and a DC voltage heating element control signal to control operation of the AC voltage heating element and the DC voltage heating element, respectively, and the fusing unit controller may output the AC voltage heating element control signal based on whether the AC voltage detector detects the AC voltage and whether the DC voltage detector detects the DC voltage.

The fusing unit controller may output the AC voltage heating element control signal based further upon a temperature of at least one of the AC voltage heating element and the DC voltage heating element.

The fusing unit controller may output the AC voltage heating element control signal based further upon a period of elapsed time since at least one of the AC voltage heating element and the DC voltage heating element has been turned on.

The fusing unit controller may include a DC voltage detection circuit, and the fusing unit controller may turn off the AC voltage heating element when the DC voltage detection circuit detects the DC voltage at the DC voltage input terminal.

BRIEF DESCRIPTION OF THE DRAWINGS

The above and/or other features of the present general inventive concept will become apparent and more readily appreciated from the following description of the exemplary embodiments, taken in conjunction with the accompanying drawings, in which.

DETAILED DESCRIPTION OF THE EMBODIMENTS

Figure 1A:
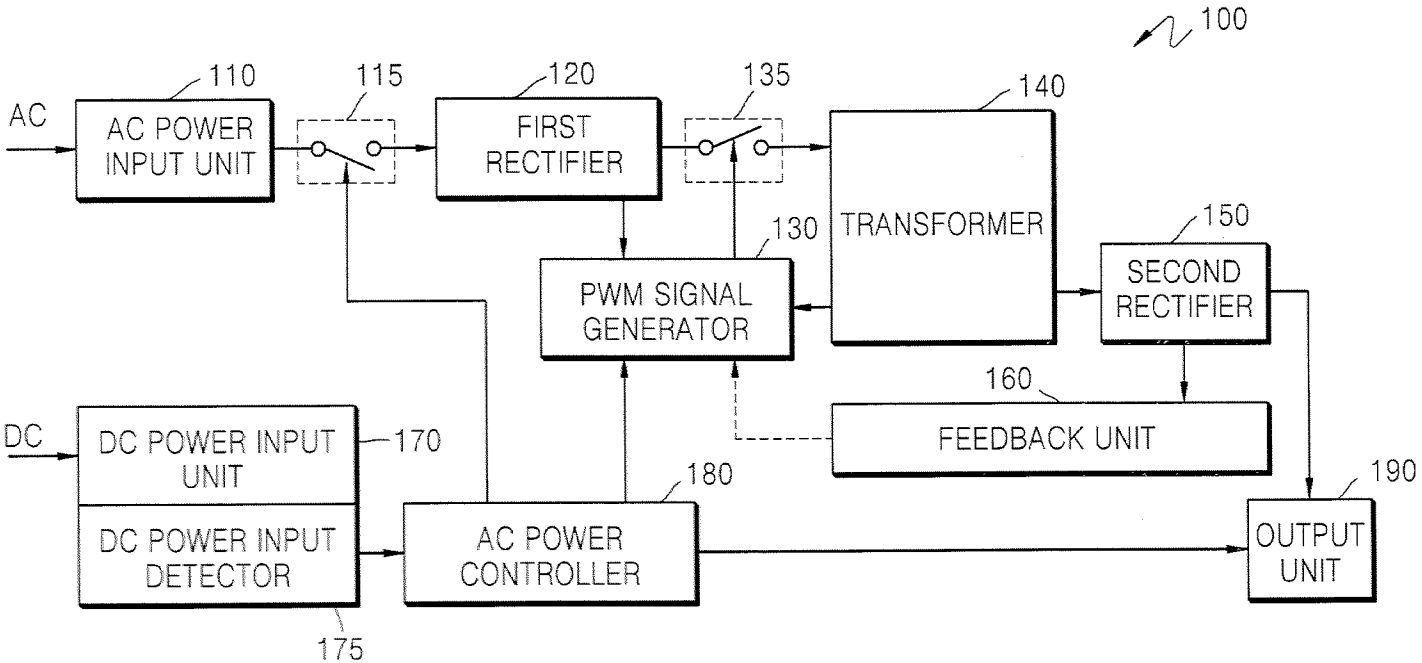
FIGS. 1A and 1B are block diagrams of a switching mode power supplying apparatus according to embodiments of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1A is a block diagram of a switching mode power supplying apparatus 100 according to an embodiment of the present general inventive concept. As shown in FIG. 1A, the switching mode power supplying apparatus 100 includes an alternating current (AC) power input unit 110, a first rectifier 120, a pulse width modulation (PWM) signal generator 130, a transformer 140, a second rectifier 150, a feedback unit 160, a direct current (DC) power input unit 170, a DC power input detector 175, and an AC power controller 180.

The AC power input unit 110 receives an AC voltage of 110 V or 220 V from an AC power supply source located outside the switching mode power supplying apparatus 100.

The first rectifier 120 performs full-wave or half-wave rectification on the received AC voltage, and outputs a DC voltage generated by performing the full-wave or half-wave rectification. The first rectifier 120 may be realized as a bridge circuit in which diodes are connected in a bridge form. The DC voltage output from the first rectifier 120 is input to a first winding wire of the transformer 140.

The PWM signal generator 130 is driven by the DC voltage output from the first rectifier 120, and outputs a PWM signal.

The transformer 140 is turned on/off according to the PWM signal output from the PWM signal generator 130. For example, the PWM signal output may be connected to a switch 135 between the first rectifier 120 and the transformer 140 to control output of the DC voltage from the first rectifier 120 to the transformer 140. When the transformer 140 is turned on according to the PWM signal, the transformer 140 transforms the DC voltage input from the first winding wire into an AC voltage according to a turn ratio, and outputs the AC voltage to a second winding wire.

The second rectifier 150 generates a DC voltage by rectifying the AC voltage output from the transformer 140 and outputs the DC voltage to an output unit 190.

The feedback unit 160 provides a feedback signal corresponding to a change of the DC voltage output from the second rectifier 150 to the PWM signal generator 130 through a photo-coupler, so as to uniformly maintain the DC voltage output from the second rectifier 150.

The DC power input unit 170 receives a DC voltage of 60 V or lower from a DC power supply source located outside the switching mode power supplying apparatus 100. The DC power input unit 170 receives the DC voltage when a connection terminal for supplying a DC voltage from the DC power supply source is connected to the DC power input unit 170.

The DC power input detector 175 detects whether the DC voltage is input to the DC power input unit 170 and outputs the detection signal to the AC power controller 180. When the DC power input detector 175 detects that DC power is input to the DC power input unit 170, the AC power controller 180 controls the voltage input to the first rectifier 120 to stop the input AC voltage so that the second rectifier 150 does not output a DC voltage to the output unit 190. Instead, the AC power controller 180 outputs the input DC voltage to the output unit 190.

Figure 1B:
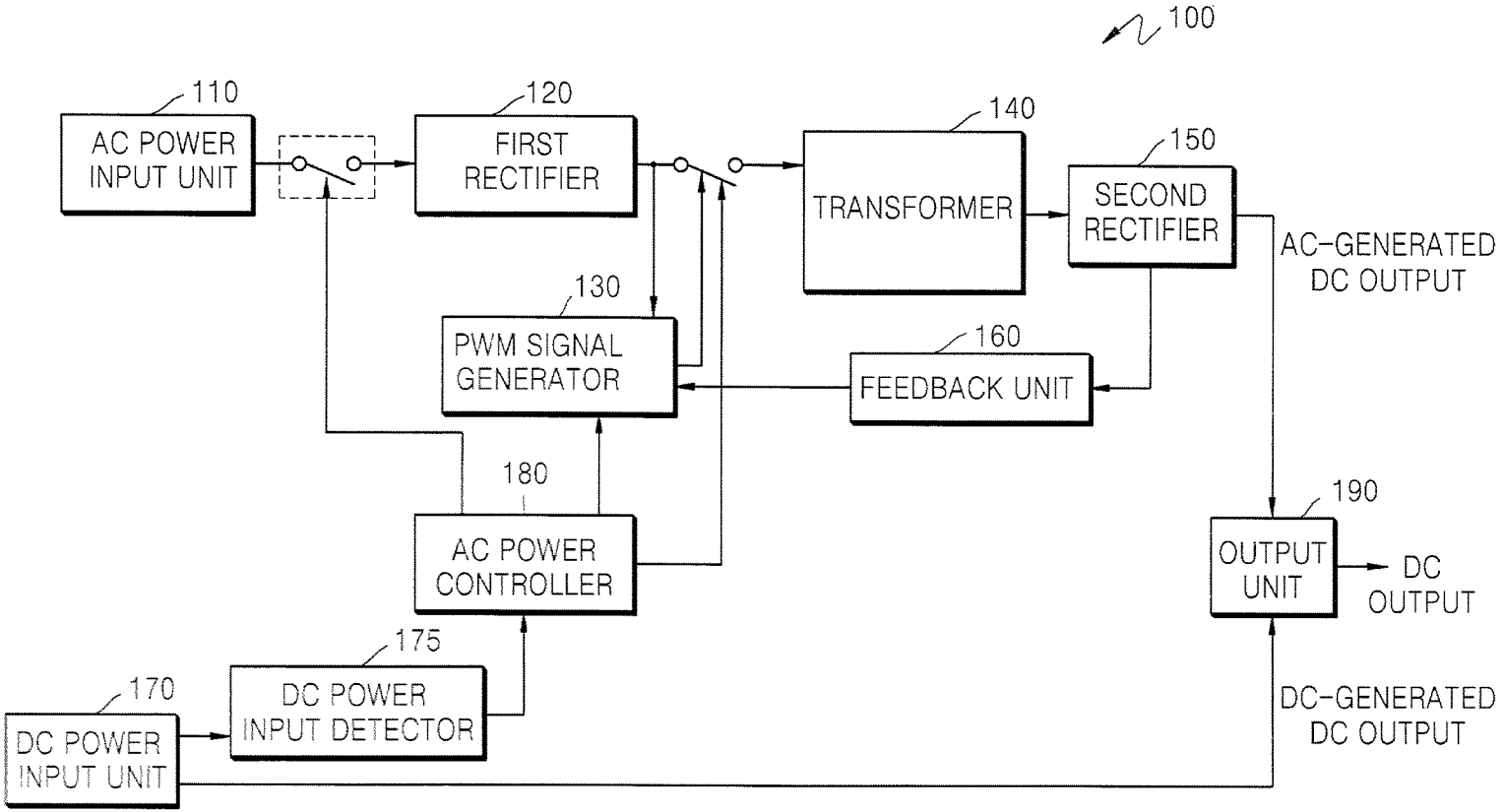

The switching mode power supply 100 of FIG. 1B is similar to the switching mode power supply apparatus 100 of FIG. 1A, except the DC voltage from the DC power input unit 170 is output directly to the output unit 190 without passing through the AC power controller 180. In addition, the DC power input unit 170 is a separate device from the DC power input detector 175. For example, the DC power input detector 175 may be a sensor to sense a DC input voltage.

Operations of the DC power input detector 175 will now be described with reference to FIGS. 2 through 4.

Figure 2:
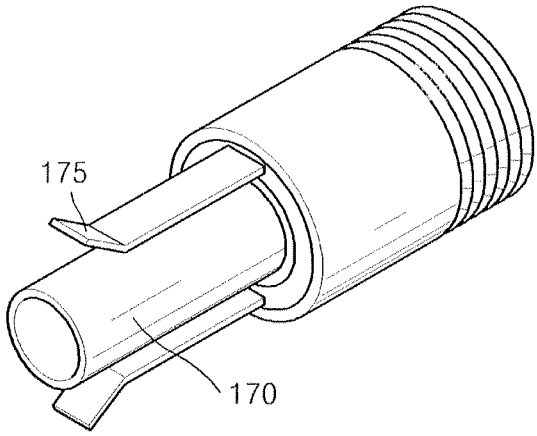
FIG. 2 is a diagram of an external shape of a direct current (DC) power input unit and a DC power input detector, according to an embodiment of the present general inventive concept.

FIG. 2 is a diagram of an external shape of the DC power input unit 170 and the DC power input detector 175 according to an embodiment of the present general inventive concept. In FIG. 2, the DC power input unit 170 is used as a ground terminal, and the DC power input detector 175 is formed of a conductive material. Also, as shown in FIG. 2, the DC power input unit 170 and the DC power input detector 175 are connected to or disconnected from each other according to connectivity between the DC power input unit 170 and the connection terminal for supplying a DC voltage. When the DC power input unit 170 and the connection terminal are not connected to each other, the DC power input unit 170 and the DC power input detector 175 are connected to each other. Alternatively, when the DC power input unit 170 and the connection terminal are connected to each other, the DC power input unit 170 and the DC power input detector 175 are disconnected from each other.

Figure 3A:
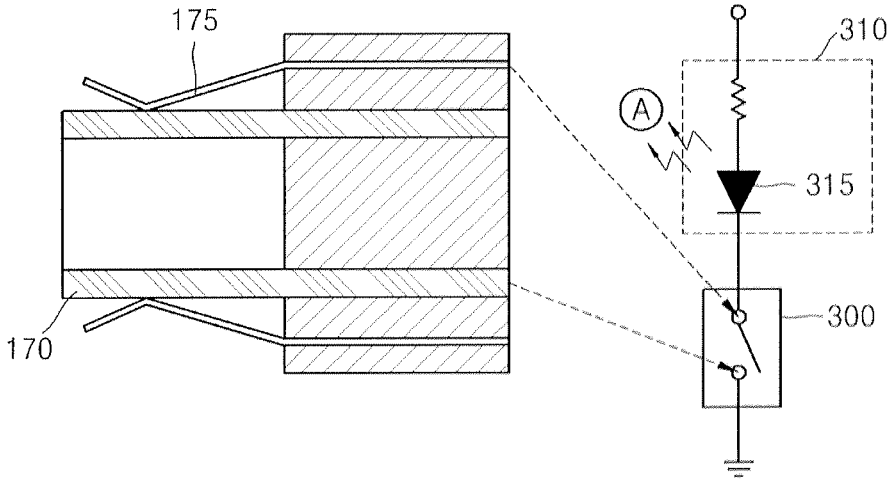
FIG. 3 is a circuit diagram of a DC power input unit and a DC power input detector, according to an embodiment of the present general inventive concept.
Figure 3B:
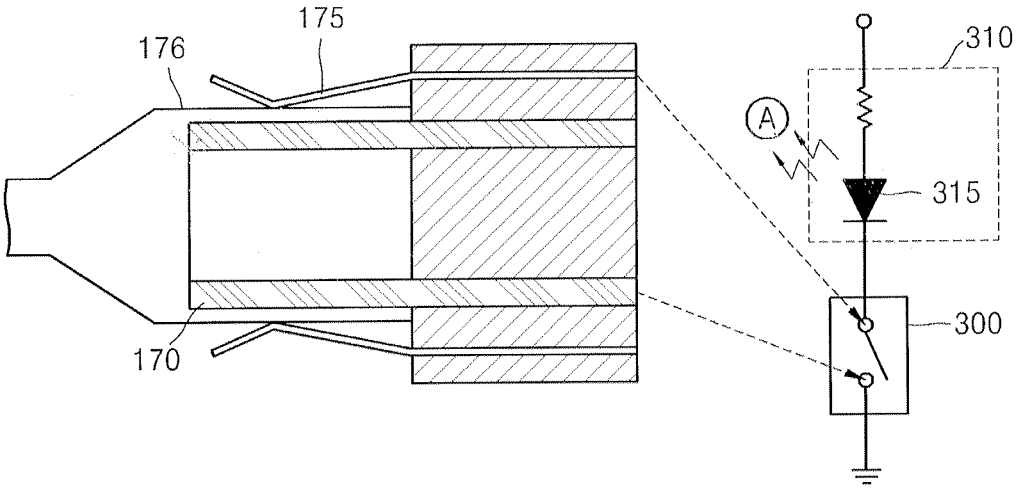

FIG. 3 is a circuit diagram of the DC power input unit 170 and the DC power input detector 175, according to an embodiment of the present general inventive concept. As shown in FIG. 3, the DC power input unit 170 and the DC power input detector 175 operate like a switch 300. The DC power input detector 175 includes a signal output unit 310 that outputs a signal according to the on/off state of the switch 300. The signal output unit 310 uses a light emitting diode 315. The light emitting diode 315 operates according to the on/off state of the switch 300 to output a DC voltage input detect signal A.

Figure 4:
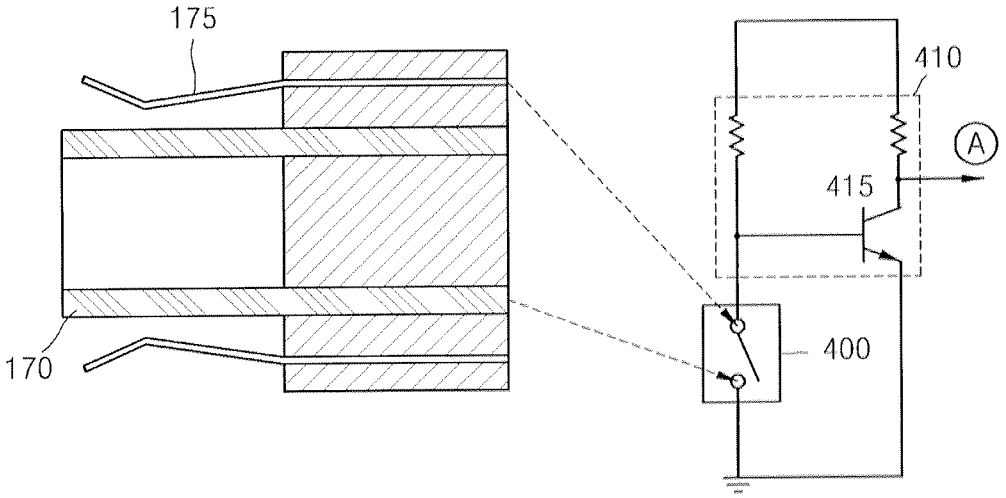
FIG. 4 is a circuit diagram of a DC power input unit and a DC power input detector, according to another embodiment of the present general inventive concept.

FIG. 4 is a circuit diagram of the DC power input unit 170 and the DC power input detector 175 according to another embodiment of the present general inventive concept. As shown in FIG. 4, the DC power input unit 170 and the DC power input detector 175 operate like a switch 400, and a transistor 415 is used as a signal output unit 410. The transistor 415 operates according to the on/off state of the switch 400, to output a DC voltage input detect signal A.

Referring back to FIG. 1A, the AC power controller 180 the output of the DC voltage based on the AC input voltage based on whether the DC power supply source is connected to the DC power input unit 170. The AC power controller 180 may stop output of the AC-input-voltage-based DC voltage output by stopping an operation of the PWM signal generator 130 or by disconnecting the first rectifier 120 from the transformer 140, for example.

The switching mode power supplying apparatus 100 according to an embodiment of the present general inventive concept includes the AC power input unit 110 and the DC power input unit 170 and may use a voltage received from the AC power input unit 110 or the DC power input unit 170. When a DC voltage is input from the DC power input unit 170, the output of a DC voltage based on the input AC voltage is stopped.

Figure 5:
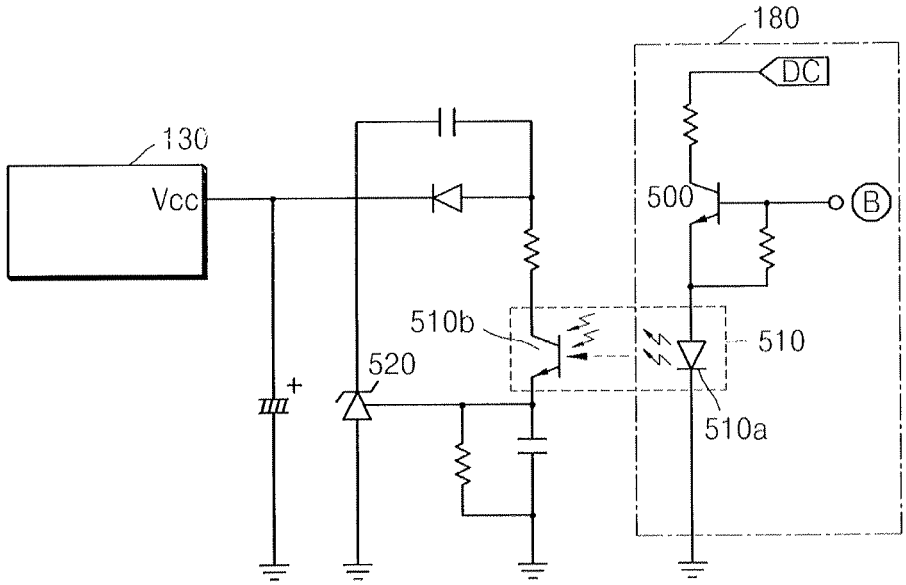
FIG. 5 is a circuit diagram to describe an operation of an alternating current (AC) power controller according to an embodiment of the present general inventive concept.

FIG. 5 is a circuit diagram to describe an operation of the AC power controller 180 according to an embodiment of the present general inventive concept in which the AC power controller 180 stops operation of the PWM signal generator 130 when a DC power input is detected. As shown in FIG. 5, the AC power controller 180 may include a transistor 500 that is turned on when a DC voltage input detect signal is received via the input terminal B, and a photo-coupler 510 transmits light from the AC power controller 180 to the light receiver 510*b* connected to the PWM signal generator 130 when the transistor 500 is turned on. When the photo-coupler 510 operates, the light emitter 510*a* that is part of the AC power controller 180 transmits light to the light receiver 510*b*. Accordingly, a thyristor 520 connected to a common-collector voltage (Vcc) terminal of the PWM signal generator 130 is turned on, and the Vcc terminal of the PWM signal generator 130 is grounded. As such, as the Vcc terminal of the PWM signal generator 130 is grounded, the operation of the PWM signal generator 130 stops, and an AC voltage is not input to the AC power input unit 110.

Figure 6:
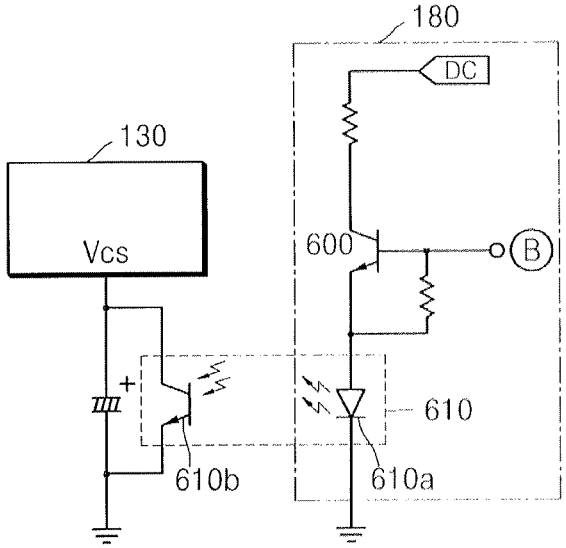
FIG. 6 is a circuit diagram to describe an operation of an AC power controller according to another embodiment of the present general inventive concept.

FIG. 6 is a circuit diagram to describe an operation of the AC power controller 180 according to another embodiment of the present general inventive concept. As shown in FIG. 6, when a DC voltage input detect signal is input through the input terminal B, the transistor 600 is turned on. When the transistor 600 is turned on, a photo-coupler 610 operates to transmit light from a light-emitter 610*a* to a light receiver 610*b*. When the light is received by the light receiver 610*b*, the light receiver 610*b* turns on, and thus a current sensing (Vcs) terminal of the PWM signal generator 130 is grounded which stops the operation of the PWM signal generator 130, and the DC voltage corresponding to the AC input voltage is not input to the transformer 140.

Figure 7:
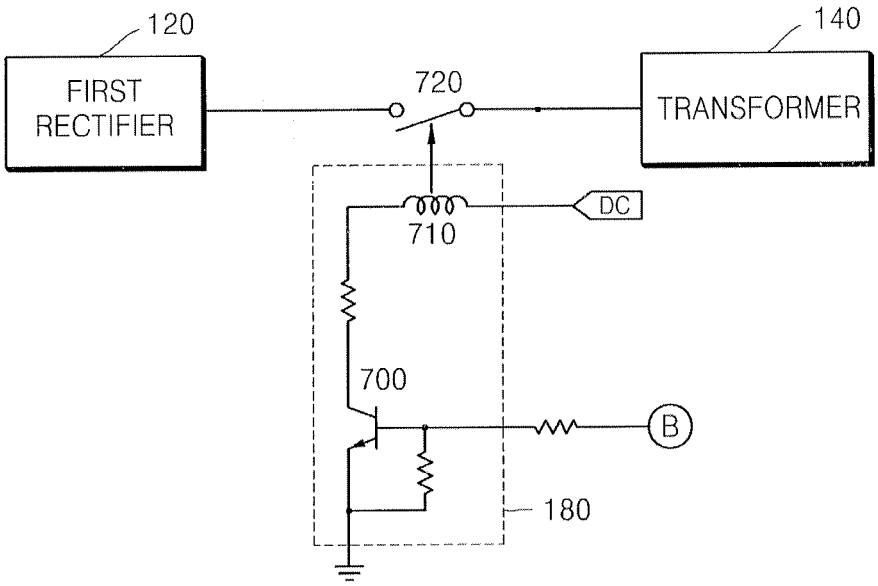
FIG. 7 is a circuit diagram to describe an operation of an AC power controller according to another embodiment of the present general inventive concept.

FIG. 7 is a circuit diagram to describe an operation of the AC power controller 180 according to another embodiment of the present general inventive concept. As shown in FIG. 7, when a DC voltage input detect signal is input through the input terminal B, a transistor 700 is turned on and an induced current is generated by an inductor 710. When the inductor 710 generates the induced current, a relay 720 connecting the first rectifier 120 to the transformer 140 is turned off. When the relay 720 is turned off, the DC voltage corresponding to the input AC voltage is not input to the transformer 140. Alternatively, the relay 702 or another switch may be located between the AC power input unit 110 and the first rectifier 120, or at an input of the AC power input unit 110.

Referring back to FIG. 1A, as described above, when DC power is input to the DC power input unit 170, the AC power controller 180 prevents the second rectifier 150 from outputting a DC voltage corresponding to the input AC voltage by interrupting the flow of the input voltage between the AC input and the second rectifier 150. Meanwhile, when a DC voltage is input to the DC power input unit 170, the AC power controller 180 outputs the input DC voltage to the output unit 190.

The switching mode power supply apparatus 100 may be implemented in an image-forming apparatus having a fusing apparatus to fuse an image to a recording medium.

Figure 8A:
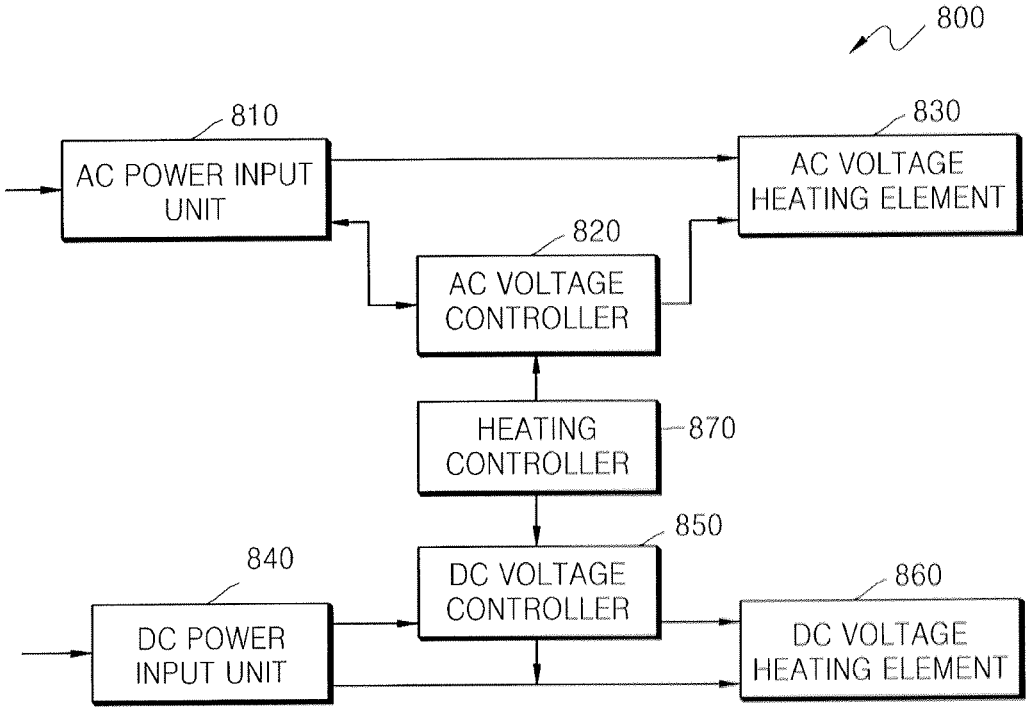
FIGS. 8A and 8B are block diagrams of a fusing apparatus according to embodiments of the present general inventive concept.

FIG. 8A is a block diagram of a fusing apparatus 800 according to an embodiment of the present general inventive concept. As shown in FIG. 8A, the fusing apparatus 800 includes an AC power input unit 810, an AC voltage controller 820, an AC voltage heating element 830, a DC power input unit 840, a DC voltage controller 850, a DC voltage heating element 860, and a heating controller 870.

The AC power input unit 810 receives an AC voltage of 110 V or 220 V from an AC power supply source located outside the fusing apparatus 800. The received AC voltage is received by each of the AC voltage controller 820 and the AC voltage heating element 830.

The AC voltage controller 820 controls an operation of the AC voltage heating element 830 by turning on/off a photo-coupler (not shown), for example, and controls a voltage input of the AC power input unit 810.

The AC voltage heating element 830 receives an AC voltage through the AC power input unit 810 and is heated according to a control signal output from the AC voltage controller 820.

The DC power input unit 840 receives a DC voltage of 60 V or lower from an external power supply source located outside the fusing apparatus 800. The received DC voltage is output to the DC voltage controller 850 and the DC voltage heating element 860.

The DC voltage controller 850 controls an operation of the voltage heating element 860 to which the DC voltage is input by outputting a control signal.

The heating controller 870 outputs a first driving signal and a second driving signal respectively to the AC voltage controller 820 and the DC voltage controller 850. When DC power is input to the DC power input unit 840, the heating controller 870 may block an AC voltage input to the AC power input unit 840 by outputting the first driving signal. Since the heating controller 870 outputs the first driving signal and the second driving signal respectively to the AC voltage controller 820 and the DC voltage controller 850, the AC voltage controller 820 and the DC voltage controller 850 independently control operations of the AC voltage heating element 830 and the DC voltage heating element 860 respectively. Accordingly, the AC voltage heating element 830 and the DC voltage heating element 860 may simultaneously operate when the fusing apparatus 800 is initially warmed up so as to reduce a first page output time (FPOT) or when an operation mode of the fusing apparatus 800 changes from a sleep mode to a print mode. In other words, when the fusing apparatus 800 initially operates, the heating controller 870 simultaneously outputs the first and second driving signals so that the AC voltage controller 820 and the DC voltage controller 850 respectively operate the AC voltage heating element 830 and DC voltage heating element 860. The heating controller 870 may determine an initial warm up time or a sleep mode by command signals, by detecting a temperature of one of the heating elements, or by determining how long it has been since at least one of the heating elements was turned on, for example.

Figure 8B:
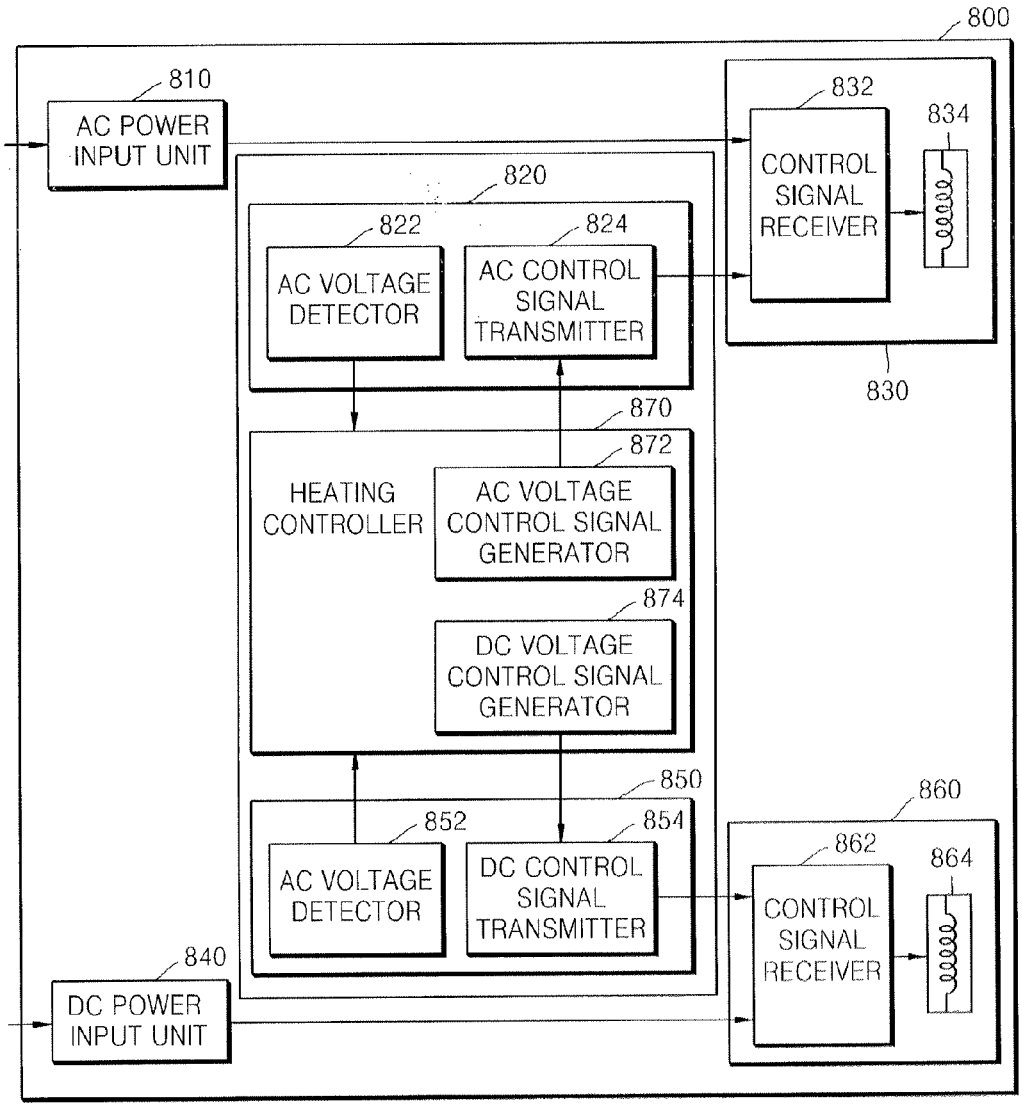

FIG. 8B is a block diagram illustrating a configuration of the fusing apparatus 800 according to an embodiment of the present general inventive concept. The fusing apparatus 800 illustrated in FIG. 8B includes an AC input 810, AC voltage heating element 830, DC input 840, and DC voltage heating element 860, similar to those of FIG. 8A. In FIG. 8B, the control unit 880 may include each of the heating controller 870, the AC voltage controller 820, and the DC voltage controller 850 of FIG. 8A. For example, the control unit 880 may be an ASIC or other circuit component or device that includes the components of the heating controller 870, AC voltage controller 820, and the DC voltage controller 850, respectively.

Each of the heating controller 870, the AC voltage controller 820, and the DC voltage controller 850 may include one or more processors, logic circuits, switches, and other supporting circuitry to output generate detection signals and control signals. For example, the AC voltage controller 820 may include a circuit similar to that of one of FIGS. 5-7 to detect an AC voltage input and to output a control signal.

The AC voltage controller 820 may include an AC voltage detector 822 to detect an AC voltage input. The AC voltage detector 821 may output an AC voltage detect signal to the heating controller 870. Likewise, the DC voltage controller 850 may include a DC voltage detector 852 to detect a DC voltage input and output a DC voltage detect signal to the heating controller 870. The heating controller 870 may determine a desired heating output of the fusing unit 800 and output heating element control signals to correspond to at least one of the AC voltage heating element 830 and the DC voltage heating element 860. The heating controller 870 may include an AC voltage control signal generator 872 and a DC voltage control signal generator 874 to output the AC and DC heating element control signals.

For example, the heating controller 870 may be configured to turn off AC power to the AC voltage heating element 830 when a DC power input is detected. On the other hand, the heating controller 870 may be programmed or designed to output control signals to operate each of the AC voltage heating element 830 and the DC voltage heating element 860 in certain circumstances, such as upon an initial start-up of the fusing apparatus 800.

The heating controller 870 may output control signals directly to the AC voltage heating element 830 and the DC voltage heating element 860 to control operation of the respective heating elements 830 and 860, or the heating controller 870 may output control signals to the respective voltage controllers 820 and 850. For example, as illustrated in FIG. 8B, the AC voltage controller 820 and the DC voltage controller 850 may each include a respective control signal transmitter 824 and 824 to transmit a respective control signal to the AC voltage heating element 830 and the DC voltage heating element 860. Each of the heating elements 830 and 860 may include control signal receivers 832 and 862 to receive the control signals and to output the AC voltage and DC voltage to the respective heating coils 834 and 864.

Figure 9:
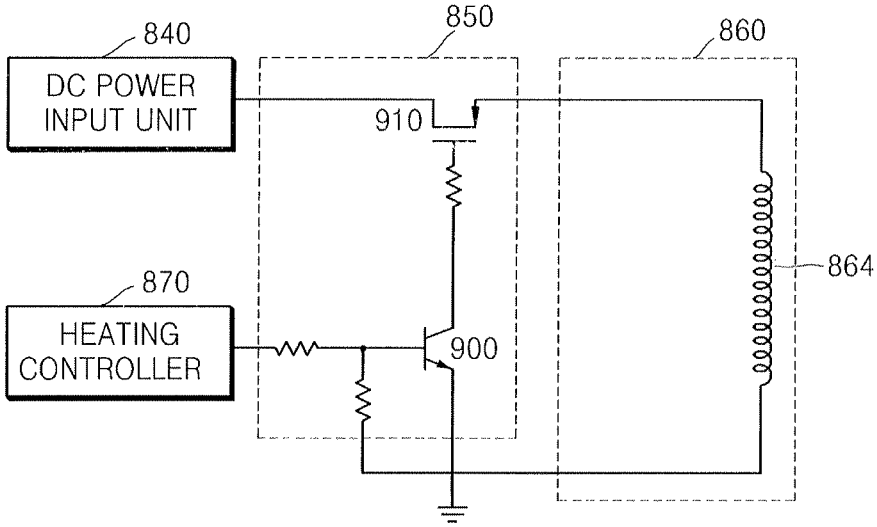
FIG. 9 is a circuit diagram to describe an operation of a DC voltage controller according to an embodiment of the present general inventive concept.

FIG. 9 is a circuit diagram to describe an operation of the DC voltage controller 850 according to an embodiment of the present general inventive concept. As shown in FIG. 9, when the second driving signal is input from the heating controller 870, a transistor 900 is turned on, and thus a gate of a metal-oxide semiconductor field effect transistor (MOSFET) 915 is grounded. Accordingly, the MOSFET 915 is turned on, and the DC voltage heating element 860 operates according to a DC voltage input through the DC power input unit 840.

Figure 10:
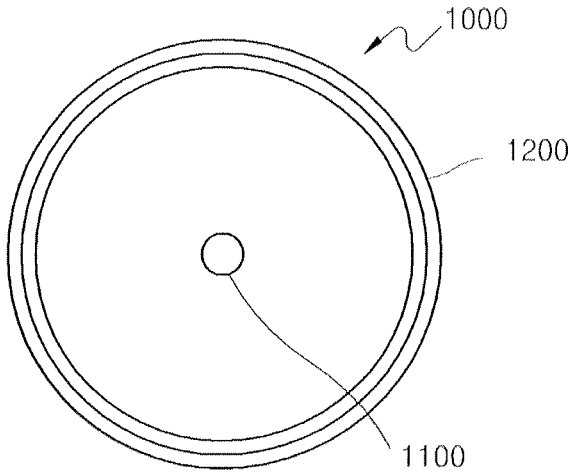
FIG. 10 is a diagram illustrating locations of an AC voltage heating element and a DC voltage heating element of a fusing apparatus according to an embodiment of the present general inventive concept.

FIG. 10 is a diagram illustrating locations of an AC voltage heating element 1100 and a DC voltage heating element 1200 of a fusing apparatus 800 according to an embodiment of the present general inventive concept. As shown in FIG. 10, the AC voltage heating element 1100 is located inside a heating roller 1000, and the DC voltage heating element 1200 is located outside the heating roller 1000.

Figure 11:
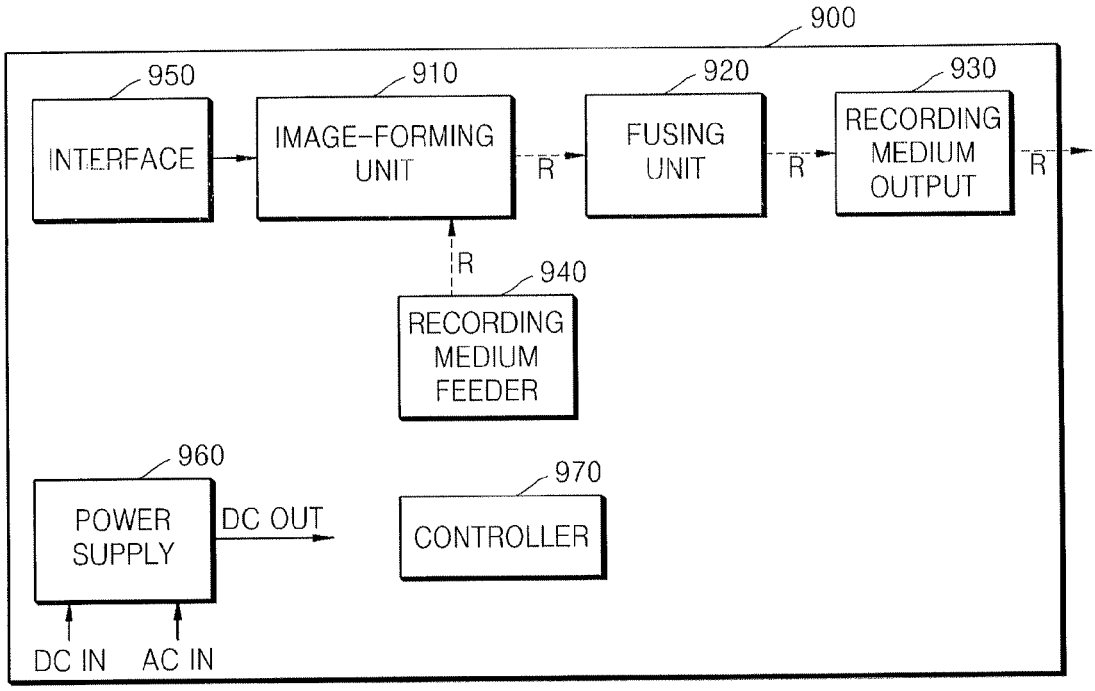
FIG. 11 is a block diagram of an image-forming apparatus according to the present general inventive concept.

FIG. 11 illustrates an image-forming apparatus 900 according to an embodiment of the present general inventive concept. The image-forming apparatus 900 may include an image-forming unit 910 to receive image data and to transform the image data into an image to be applied to a recording medium. The image-forming unit 910 may include a light-emitting unit to expose a photosensitive unit with an image pattern and any other image-forming components including rollers to transmit the image, toner, ink, etc.

A recording medium feeder 940 may feed the recording medium R, such as paper, to the image-forming unit 910 which applies the image to the recording medium R. The image-forming unit 910 may transmit the recording medium to a fusing unit 920 to fuse the image to the recording medium R. The fusing unit 920 may be similar to the fusing apparatus 800 of FIGS. 8A-10, for example. The fusing unit 920 may receive AC power, DC power, or both AC and DC power. The recording medium output 930 may output the recording medium to an external device, a storage area, or any other desired location. An interface 950 may receive the image data from an external device via a data line or wirelessly, or it may generate the image data via a scanner, for example. As such, the interface may include one or more data ports, an antenna, a scanning unit, or any other image-receiving interface. The interface 950 may also include a user interface to receive an input from a user.

A power supply 960 may supply power to one or more of the functional units of the image-forming apparatus 900, and controller 970 may control each of the functional units of the image-forming apparatus. The power supply 960 may be similar to the power supply 100 illustrated in FIG. 1A, for example. The power supply 960 may receive AC power, DC power, or both AC and DC power.

The embodiments of the present general inventive concept can be written as computer programs and can be implemented in general-use digital computers that execute the programs using a computer readable recording medium. The structure of data used in the embodiments of the present general inventive concept may be recorded on the computer readable recording medium by using different methods. Examples of the computer readable recording media include magnetic storage media (e.g., ROM, floppy disks, hard disks, etc.) and optical recording media (e.g., CD-ROMs, or DVDs).

While this general inventive concept has been particularly shown and described with reference to preferred embodiments thereof, it will be understood by those of ordinary skill in the art that various changes in form and details may be made without departing from the spirit and scope of the general inventive concept as defined by the appended claims. The preferred embodiments should be considered in descriptive sense only and not for purposes of limitation. Therefore, the scope of the general inventive concept is defined not by the detailed description of the general inventive concept but by the appended claims, and all differences within the scope will be construed as being included in the present general inventive concept.

Although a few embodiments of the present general inventive concept have been shown and described, it would be appreciated by those skilled in the art that changes may be made in these embodiments without departing from the principles and spirit of the general inventive concept, the scope of which is defined in the claims and their equivalents.

What is claimed is:

1. A switching mode power supply apparatus comprising:
- an alternating current (AC) power input unit to receive a first AC voltage from an AC power supply source;
- a first rectifier to output a first direct current (DC) voltage by rectifying the received first AC voltage;
- a pulse width modulation (PWM) signal generator to output a PWM signal according to the first DC voltage;
- a transformer to transform the first DC voltage output from the first rectifier into a second AC voltage according to a turn ratio and to output the second AC voltage according to the PWM signal;
- a second rectifier to output a second DC voltage by rectifying the second AC voltage output from the transformer;
- a feedback unit to provide as feedback to the PWM signal generator a change of the second DC voltage output from the second rectifier;
- a DC power input unit to receive a third DC voltage from a DC power supply source;
- a DC voltage input detector to detect whether the third DC voltage is input to the DC power input unit; and
- an AC power input controller to stop generation of the second DC voltage when the DC voltage input detector detects that the third DC voltage is input to the DC power input unit.

2. The switching mode power supplying apparatus of claim 1, wherein the DC voltage input detector comprises a signal output unit to output a DC voltage input detect signal when a DC voltage is input to the DC power input unit.

3. The switching mode power supplying apparatus of claim 2, wherein the signal output unit comprises a light emitting diode to output the DC voltage input detect signal when a DC voltage is input to the DC power input unit.

4. The switching mode power supplying apparatus of claim 2, wherein the signal output unit comprises a transistor to output the DC voltage input detect signal when a DC voltage is input to the DC power input unit.

5. The switching mode power supplying apparatus of claim 1, wherein the AC power input controller comprises a light emitter of a photo-coupler, and when a DC voltage is input to the DC power input unit, the photo-coupler operates to stop an operation of the PWM signal generator.

6. The switching mode power supplying apparatus of claim 5, wherein the PWM signal generator comprises a common-collector voltage (Vcc) terminal connected to a thyristor and a light receiver of the photo-coupler connected in parallel, and when the photo-coupler operates, the thyristor turns on to ground the Vcc terminal to stop operation of the PWM signal generator.

7. The switching mode power supplying apparatus of claim 5, wherein the PWM signal generator includes a terminal to receive a current sensing signal (Vcs) to which a light receiver of the photo-coupler is connected, and when the photo-coupler operates, the Vcs terminal is grounded to stop operation of the PWM signal generator.

8. The switching mode power supplying apparatus of claim 1, wherein the AC power input controller includes an inductor and a transistor, and when a DC voltage is input to the DC power input unit, a relay connecting the first rectifier to the transformer is turned off according to an induced current of the inductor generated as the transistor is turned on.

9. The switching mode power supplying apparatus of claim 1, wherein an output voltage of the switching mode power supplying apparatus is connected to at least one component of an image forming apparatus to supply power to the image-forming apparatus.

10. A fusing apparatus comprising:

an alternating current (AC) power input unit to receive an AC voltage from an AC power supply source;

an AC voltage heating element to emit heat according to the AC voltage;

an AC voltage controller to control a voltage input operation of the AC power input unit and a heat emitting operation of the AC voltage heating element;

a direct current (DC) power input unit to receive a DC voltage from a DC power supply source;

a DC voltage heating element to emit heat according to the DC voltage;

a DC voltage controller to control a heat emitting operation of the DC voltage heating element; and a heating controller for independently controlling the AC voltage controller and the DC voltage controller by outputting a first driving signal to the AC voltage controller to control an operation of the AC voltage controller and a second driving signal to the DC voltage controller to control an operation of the DC voltage controller, wherein, when a DC voltage is input to the DC power input unit, the heating controller blocks an AC voltage input to the AC power input unit by outputting the first driving signal.

11. The fusing apparatus of claim 10, wherein the AC voltage heating element is located inside a heating roller used in the fusing apparatus, and the DC voltage heating element is located on a surface of the heating roller.

12. The fusing apparatus of claim 10, wherein the DC voltage controller includes a transistor and a metal-oxide semiconductor field effect transistor (MOSFET), and when a driving signal is input from the heating controller, the MOSFET is turned on as the transistor is turned on to cause the DC voltage heating element to emit heat.

13. The fusing apparatus of claim 10, wherein, prior to the DC voltage being input to the DC power input unit and only when the fusing apparatus is initially warmed up or when an operation mode of the fusing apparatus is changed from a sleep mode to a printing mode, the heating controller simultaneously outputs the first and second driving signals so that the AC voltage heating element and the DC voltage heating element simultaneously emit heat.

14. A power supply, comprising:

an AC voltage input terminal;

a DC voltage input terminal;

an AC-to-DC conversion circuit to convert a first AC voltage received at the AC voltage input terminal to a first DC voltage to be output from the power supply;

a DC voltage input detection circuit to detect a second DC voltage received at the DC voltage input terminal; and a voltage control circuit to disable the AC-to-DC conversion circuit in response to the DC voltage input detection circuit detecting the second DC voltage being received at the DC voltage input terminal.

15. The power supply according to claim 14, wherein the DC voltage input terminal includes a mechanical switch, and the mechanical switch is a part of the DC voltage input detection circuit.

16. The power supply according to claim 14, wherein, when the second DC voltage is input to the DC voltage input terminal, the voltage control circuit causes the second DC voltage to be output from the power supply.

17. The power supply according to claim 14, wherein the AC-to-DC conversion circuit comprises:

a first rectifier to convert the first AC voltage to a third DC voltage;

a transformer to convert the third DC voltage to a second AC voltage different from the first AC voltage;

a second rectifier to convert the second AC voltage to the first DC voltage; and a pulse width modulation (PWM) signal generator to control operation of the transformer.

18. The power supply according to claim 17, wherein the voltage control circuit causes the PWM signal generator to stop an input of the third DC voltage to the transformer when the DC voltage input detection circuit detects the second DC voltage.

19. The power supply according to claim 18, wherein the voltage control circuit drives to ground a power supply voltage to the PWM signal generator when the DC voltage input detection circuit detects the second DC voltage.

20. The power supply according to claim 17, further comprising:

a switch located between the AC power input terminal and the first rectifier, wherein, when the DC voltage input detection circuit detects the second DC voltage, the voltage control circuit opens the switch to prevent the first AC voltage from being transmitted to the first rectifier.

21. An image-forming apparatus, comprising:

an image-forming unit to transfer an image to a recording medium;

an AC voltage input terminal;

a DC voltage input terminal; and a power supply, comprising:

an AC-to-DC conversion circuit to convert a first AC voltage received at the AC voltage input terminal to a first DC voltage to be output from the power supply;

a DC voltage input detection circuit to detect a second DC voltage received at the DC voltage input terminal; and a voltage control circuit to disable the AC-to-DC conversion circuit in response to the DC voltage input detection circuit detecting the second DC voltage being received at the DC voltage input terminal.

22. The image-forming apparatus according to claim 21, further comprising:

a fusing unit to fuse the image to the recording medium, the fusing unit comprising:

an AC voltage heating element to receive an AC voltage from the AC voltage input terminal and to generate heat based on the received AC voltage;

a DC voltage heating element to receive a DC voltage from the DC voltage input terminal and to generate heat based on the received DC voltage; and a fusing unit controller to receive the AC voltage and the DC voltage and to output an AC voltage heating element control signal and a DC voltage heating element control signal to control operation of the AC voltage heating element and the DC voltage heating element, respectively.

23. The image-forming apparatus according to claim 22, wherein the fusing unit controller comprises:

an AC voltage detector; and a DC voltage detector, wherein the fusing unit controller outputs the AC voltage heating element control signal based on whether the AC voltage detector detects the AC voltage and whether the DC voltage detector detects the DC voltage.

24. The image-forming apparatus according to claim 23, wherein the fusing unit controller outputs the DC voltage heating element control signal based only on whether the DC voltage detector detects the DC voltage.

25. The image-forming apparatus according to claim 23, wherein the fusing unit controller comprises:

an AC voltage controller including the AC voltage detector;

a DC voltage controller including the DC voltage detector; and a heating controller to receive an AC voltage detection signal from the AC voltage detector and a DC voltage detection signal from the DC voltage detector and to output the AC voltage heating element control signal and the DC voltage heating element control signal.

26. The image-forming apparatus according to claim 25, wherein the heating controller outputs the AC voltage heating element control signal and the DC voltage heating element control signal directly to the AC voltage heating element and the DC voltage heating element, respectively.

27. The image-forming apparatus according to claim 25, wherein the heating controller outputs the AC voltage heating element control signal and the DC voltage heating element control signal to the AC voltage controller and the DC voltage controller, respectively, to control operation of the AC voltage heating element and the DC voltage heating element, respectively.

28. A fusing unit of an image-forming apparatus, comprising:

an AC voltage heating element to receive an AC voltage from an AC voltage input terminal and to generate heat based on the received AC voltage;

a DC voltage heating element to receive a DC voltage from a DC voltage input terminal and to generate heat based on the received DC voltage; and a fusing unit controller to receive the AC voltage and the DC voltage and to output an AC voltage heating element control signal and a DC voltage heating element control signal to control operation of the AC voltage heating element and the DC voltage heating element, respectively, wherein the fusing unit controller outputs the AC voltage heating element control signal based on whether the AC voltage detector detects the AC voltage and whether the DC voltage detector detects the DC voltage.

29. The fusing unit according to claim 28, wherein the fusing unit controller outputs the AC voltage heating element control signal based further upon a temperature of at least one of the AC voltage heating element and the DC voltage heating element.

30. The fusing unit according to claim 28, wherein the fusing unit controller outputs the AC voltage heating element control signal based further upon a period of elapsed time since at least one of the AC voltage heating element and the DC voltage heating element has been turned on.

31. The fusing unit according to claim 28, wherein the fusing unit controller includes a DC voltage detection circuit, and the fusing unit controller turns off the AC voltage heating element when the DC voltage detection circuit detects the DC voltage at the DC voltage input terminal.

* * * * *